US008328165B2

(12) United States Patent
Eschelbacher et al.

(10) Patent No.: US 8,328,165 B2
(45) Date of Patent: Dec. 11, 2012

(54) HOIST WITH OVERSPEED PROTECTION

(75) Inventors: Lawrence L. Eschelbacher, Marcellus, NY (US); Peter V. Svitavsky, Port Byron, NY (US)

(73) Assignee: J.R. Clancy, Inc., Syracuse, NY (US)

( * ) Notice: Subject to any disclaimer, the term of this patent is extended or adjusted under 35 U.S.C. 154(b) by 704 days.

(21) Appl. No.: 12/554,186

(22) Filed: Sep. 4, 2009

(65) Prior Publication Data

US 2010/0237306 A1 Sep. 23, 2010

Related U.S. Application Data

(60) Provisional application No. 61/160,849, filed on Mar. 17, 2009.

(51) Int. Cl.
*B66D 1/48* (2006.01)

(52) U.S. Cl. ..... 254/267; 254/268

(58) Field of Classification Search ..... 254/267, 254/268

See application file for complete search history.

(56) References Cited

U.S. PATENT DOCUMENTS

| | | | | |
|---|---|---|---|---|
| 3,995,831 | A * | 12/1976 | Spanski et al. | 254/361 |
| 4,448,396 | A * | 5/1984 | Delago | 254/340 |
| 4,493,479 | A | 1/1985 | Clark | |
| 6,029,951 | A | 2/2000 | Guggari | |
| 6,186,248 | B1 * | 2/2001 | Silay et al. | 175/27 |
| 7,841,583 | B1 * | 11/2010 | Kureck | 254/267 |
| 2001/0045549 | A1 | 11/2001 | Johnson | |
| 2005/0098768 | A1 | 5/2005 | Malek et al. | |

FOREIGN PATENT DOCUMENTS

| | | |
|---|---|---|
| JP | 08290897 | 11/1996 |
| JP | 2001233589 | 8/2001 |

* cited by examiner

*Primary Examiner* — Emmanuel M Marcelo
(74) *Attorney, Agent, or Firm* — George R. McGuire; Bond Schoeneck & King, PLLC

(57) ABSTRACT

A hoist system with an overspeed detection sub-system for detecting overspeed by comparing an actual drum assembly speed with a target value. For example, the rotation of a motor may be determined by a first rotary encoder and the rotation of a drum may be determined by a second rotary encoder. The output of the first rotary encoder (the basis of a target value) is compared with the output of the second rotary encoder (corresponding to actual motion of the drum). If the difference between the target value and the actual motion is too large, then a problem, such as a broken hoist hardware component may exist, and appropriate remedial action is taken, such as braking the motor and/or the drum.

20 Claims, 3 Drawing Sheets

HOIST WITH OVERSPEED PROTECTION

RELATED APPLICATION

The present application claims priority to U.S. provisional patent application No. 61/160,849, filed on Mar. 17, 2209; all of the foregoing patent-related document(s) are hereby incorporated by reference herein in their respective entirety(ies).

BACKGROUND OF THE INVENTION

1. Field of the Invention

The present invention relates to powered hoists (see DEFINITIONS section) and more particularly to powered hoists for theatrical applications.

2. Description of the Related Art

Hoists are conventional, and the use of powered hoists in theatres to raise, lower and otherwise move lighting and scenery and the like is also conventional. In conventional hoist systems, a widely employed mechanical overspeed brake uses a centrifugal device to detect excessive rotational speed and to deploy linkages to engage a disk or drum brake. This type of brake is sometimes referred to herein as a "mechanical brake." In a conventional a mechanical brake, the rotational speed that will cause the centrifugal device to deploy its linkages, and brake the rotation, is called the "trigger speed." The centrifugal device is conventionally designed so that its trigger speed is at or slightly above the "rated speed," which is the maximum rotational speed at which the hoist travels in normal use. Conventional mechanical brake overspeed protection works well because it allows the lift to perform normal operations, but it will quickly and reliably brake when the rotational speed is too great.

Another type of conventional braking technology is herein referred to as an "electrical brake" because the is controlled by a control signal. As the term "electric brake" is used herein, the electric brake may be fully electric, or, it may be spring applied and electrically released. Generally, electric brakes are controlled by a control signal. In some systems, the control signal is turned on to activate the brake. In other systems, the control signal maintains the brake in a deactivated state, while turning on the control signal will serve to activate the brake. For example, if the electric brake is spring loaded and electrically released, and the system is structured and/or programmed so that turning on the control signal activates the brake, then a total loss of power would be one fault condition that would activate the electric brake. However, many variations are possible. An example of a conventional hoist system 400, with electric brakes, is shown in FIG. 4. As shown in FIG. 4, system 400 includes: load 401; first encoder 402; electric motor 404; reducer 405; motor brake 406 (an electric brake); drum brake 407 (another electric brake); drum assembly 408; cable 409; second encoder 410; first brake controller module 416*a*; and second brake controller module 416*b*. The first encoder detects rotation of a rotating portion of the motor and sends a corresponding electrical signal to the first brake controller. The first brake controller uses this signal to determine how fast the motor is rotating and to determine whether an overspeed condition exists in the motor. If there is an overspeed condition in the motor, then the first brake controller sends an electrical control signal to activate the motor brake and thereby slow and stop the hoist. The second encoder detects rotation of a rotating portion of the drum assembly and sends a corresponding electrical signal to the second brake controller. The second brake controller uses this signal to determine how fast the motor is rotating and to determine whether an overspeed condition exists in the drum assembly. If there is an overspeed condition in the drum assembly, then the second brake controller sends an electrical control signal to activate the drum brake to thereby slow and stop the hoist. By using two encoders and two brakes, there is redundancy in the braking sub-system, which is believed to increase reliability and safety.

U.S. Pat. No. 5,996,970 ("Auerbach") discloses a theatrical rigging system including a counterweight, a motor, a control chain connected to a motor, a brake, a gear box, a cogbelt, scenery, a computer control system and a positioning encoder. The positioning encoder is connected to the cogbelt. The positioning encoder produces an indication of the position of the control chain and thus the scenery. Data output from the positioning encoder is sent to the computer control system. Auerbach states: "The digital encoder provides telemetry control to the master rigging control. The digital encoder is driven by a cogbelt from the output shaft to the gear box. The encoder also has programmed limits. The gear motor is mounted on a self-aligning tensioning base." (Note: Figure numbers and reference numbers in the preceding quote relate to the Auerbach document and not this document.)

U.S. Pat. No. 6,297,610 ("Bauer") discloses a system of motor driven winches. The Bauer system includes two types of encoders: (i) the motors each include an encoder or resolver that outputs velocity feedback signals to a VSD 10 through a matrix; and (ii) a position (or velocity) encoder is mounted on the motor shaft so as to provide encoded positional (velocity) signals to an axis controller through the matrix and a termination panel. Bauer further discloses that a satellite module is coupled to monitor the incremental encoder to provide local storage of data relevant to the motor to which it is coupled.

U.S. Pat. No. 7,079,427 ("Power") discloses an automatic drilling system that includes an electric servo motor operatively coupled to a winch brake drum. Power further discloses that: "A rotary encoder 166 is rotationally coupled to the drum 162. The encoder 166 generates a signal related to the rotational position of the drum 162. Both the servo motor 150 and the encoder 166 are operatively coupled to a controller 168 . . . . The servo motor 150 includes an internal sensor (not shown separately in FIG. 3), which may be a rotary encoder similar to the encoder 166, or other position sensing device, which communicates the rotational position of the servo motor 150 to the controller 168. The encoder 166 in the present embodiment can be a sine/cosine output device coupled to an interpolator (not shown separately) in the controller 168. The encoder 166 in the present embodiment, in cooperation with the interpolator, generates the equivalent of approximately four million output pulses for each complete rotation of the drum 162, thus providing extremely precise indication of the rotational position of the drum 162 at any instant in time . . . . The controller 168 determines, at a selected calculation rate, the rotational speed of the drum 162 by measuring the rate at which pulses from the encoder 166 are detected." (Note: Figure numbers and reference numbers in the preceding quote relate to the Power document and not this document.)

Description of the Related Art Section Disclaimer: To the extent that specific publications are discussed above in this Description of the Related Art Section, these discussions should not be taken as an admission that the discussed publications (for example, published patents) are prior art for patent law purposes. For example, some or all of the discussed publications may not be sufficiently early in time, may not reflect subject matter developed early enough in time and/or may not be sufficiently enabling so as to amount to prior art for patent law purposes. To the extent that specific publications are discussed above in this Description of the Related Art Section, they are all hereby incorporated by reference into this document in their respective entirety(ies).

BRIEF SUMMARY OF THE INVENTION

Despite the perceived effectiveness of conventional mechanical and/or electrical overspeed (see DEFINITIONS section) braking sub-systems in conventional hoist systems, the present inventors have recognized that there are certain subtle drawbacks or disadvantages in the conventional technology as will now be discussed. For slower, fixed speed hoists conventional mechanical brake technology works well because the fixed rotational speed in operation will generally be up close to the rated speed and just a little bit below the trigger speed of the centrifugal device that trips the brake. In other words, the lift doesn't have to start travelling much faster than its fixed speed before the centrifugal device springs into action to arrest any problem before too much time has passed and before too much unwanted load distance, load velocity and/or load acceleration has occurred. Furthermore, when the operating speeds are relatively slow, there is a larger margin for error because the hoist and load are always travelling at a relatively slow speed.

However, for faster hoists, and more especially for faster variable speed units, setting the trigger speed of a mechanical brake to correspond to the maximum speed of the hoist creates a condition in which in the event of a failure at low speed the hoisted load could potentially accelerate downward from rest (or a very slow operating speed) to just beyond the full rated speed of the hoist before the brake is activated. In other words, the trigger speed is based on the fastest speeds that the variable speed lift is designed for, and these may be quite a bit faster than the operating speed at which an overspeed problem starts to manifest itself. The shock loading associated with stopping the load from a higher speed increases the chance of damage or injury to the operators, the load, or even to the structure to which the hoist is attached. Moreover, the fact that the mechanical brake waits for the overspeed to reach the trigger speed means that considerable time may pass and considerable unwanted load distance, load velocity and load acceleration may need to accrue before the trigger speed is reached.

Conventional electrical brakes may be subject to similar performance issues, especially when there is merely a single fixed maximum speed set point (see DEFINITIONS section) for each electrical brake(s) present in the braking sub-system (s).

This invention improves upon the conventional hoist braking sub-system technologies by comparing the output of encoders (or other rotational motion detectors) to each other (on some normalized basis, as may be appropriate). By comparing the difference in respective rotational velocities at various portions of the lift, overspeed conditions may be detected more quickly, reliably, accurately. Also, in preferred embodiments of the invention, the rotational velocity of each encoder is still compared to a maximum speed set point, so that the extra protection provided by encoder output comparison is supplemental in nature. Although not necessarily preferred, conventional mechanical brakes may also be included to provide redundancy.

In preferred embodiments, as many rotational components of the hoist as feasible should be located between the rotational motion detection devices. In preferred embodiments, rotational components that are relatively likely to malfunction or develop problems should be located between the rotational motion detection devices. When rotational hoist components are located between the rotational motion detection devices, then any problem that may develop in the component is especially likely to quickly manifest itself as an unexpected difference between the (normalized) rotational motions detected by the rotational motion detection devices. Alternatively, more than two rotational motion detection devices can be used to provide more isolation of rotational components and more granularity of hoist diagnostic type information when the outputs of the more than two rotational motion detection devices are compared.

As mentioned above, rotational velocities, from rotational output detection devices are compared on a normalized basis. As a simple example, if one turn of a motor results in a single turn of a sprocket, then the rotational velocities (and/or rotational accelerations and/or rotational positions) would be compared directly by the comparison algorithm. In preferred embodiments, the rotational motion detection devices are separated by a reducer or gear train characterized by a gear ratio, which is a constant proportional relationship between rotation on one side of the reducer and the other. In these preferred embodiments, the comparison algorithm would multiply one or both detected rotational motions (velocity, position or acceleration) by appropriate factors to account for the gear ratio. In some embodiments of the present invention, the relationship between the respective rotations expected at the respective rotational motion detectors may be characterized by different gear ratios at different times due to gear changes. This can be compensated for by the comparison algorithm. Although not necessarily preferred, other embodiments of the present invention may have the expected rotational motions related by more complicated mathematical functions, or may be subject to some degree of random variation (for example, in a friction driven rotational coupling that is designed to slip somewhat). Whatever the relationship is, it should be accounted for in the comparison algorithm to prevent: (i) brake activation when there really is no problem; and (ii) failure to activate the brake when an overspeed condition is manifest.

Although discussion to this point has focused on hoist braking sub-systems, which are indeed a highly preferred application for the rotational motion comparison technology of the present invention, it is noted that the present invention may have applications besides braking sub-systems. For example, in a hoist with a clutch type rotational coupling, the comparison of rotational motions may be used in detecting problems with the clutch. As a further example, comparison of the rotational motions could be used as a form of feedback used in ongoing control of the hoist motor. As a further example, the comparison of rotation motions may be used to detect and/or control compensation for conditions like excessive gear backlash, chain stretch or belt slippage.

According to an aspect of the present invention, a hoist system includes a drum assembly, a drum brake, a motor assembly, a motor brake, a first encoder, a second encoder, and a controller module. The motor assembly is structured, connected, programmed and/or located to drive the drum assembly to rotate. The second encoder is connected, structured, connected and/or located to detect rotational velocity of a portion of the drum assembly and to output a second encoder output signal corresponding to the drum assembly rotational velocity. The first encoder is connected, structured, programmed and/or located to detect rotation of a portion of the motor assembly and to output a first encoder output signal corresponding to the motor assembly rotational velocity. The controller module is structured, connected and/or programmed to receive the first encoder output signal and the second encoder output signal, to compare the first encoder output signal and the second encoder output signal, to determine whether an overspeed condition exists in the hoist system based on the comparison, and to output a motor brake control signal and a drum brake control signal upon determination of an overspeed condition. The motor brake is structured, connected, located and/or programmed to receive motor brake control signals from the controller module and to brake the rotation of the motor upon receipt of a motor brake control signal (see DEFINITIONS section). The drum brake is structured, connected, located and/or programmed to receive a drum brake control signals from the controller module and to brake the rotation of the drum assembly upon receipt of a drum brake control signal.

According to a further aspect of the present invention, a hoist system includes a rotating hoist member assembly, a motor assembly, a first rotational motion detection device, a second rotational motion detection device, a brake and a controller module. The motor assembly is structured, connected, programmed and/or located to drive the rotating hoist member assembly to rotate. The first rotational motion detection device is connected, structured, connected and/or located to detect rotational motion of a first portion of the hoist system and to output a first output signal corresponding to the detected rotational motion. The second rotational motion detection device is connected, structured, programmed and/or located to detect rotational motion of a second portion of the hoist system (which is different than the first portion) and to output a second output signal corresponding to the detected rotational motion. The controller module is structured, connected and/or programmed to receive the first output signal and the second output signal, to compare the first output signal and the second output signal, to determine whether a rotational mismatch condition exists in the hoist system based on the comparison, and to output a brake control signal upon determination of an rotational mismatch condition. The brake is structured, connected, located and/or programmed to receive brake control signals from the controller module and to brake the rotation of the hoist system upon receipt of a brake control signal.

According to a further aspect of the present invention, a hoist system includes a rotating hoist member assembly, a motor assembly, a first rotational motion detection device, a second rotational motion detection device, and a controller module. The motor assembly is structured, connected, programmed and/or located to drive the rotating hoist member assembly to rotate. The first rotational motion detection device is connected, structured, connected and/or located to detect rotational motion of a first portion of the hoist system and to output a first output signal corresponding to the detected rotational motion. The second rotational motion detection device is connected, structured, programmed and/or located to detect rotational motion of a second portion of the hoist system (which is different than the first portion) and to output a second output signal corresponding to the detected rotational motion. The controller module is structured, connected and/or programmed to receive the first output signal and the second output signal, to compare the first output signal and the second output signal, to determine whether a rotational mismatch condition exists in the hoist system based on the comparison, and to output a control signal upon determination of an rotational mismatch condition.

BRIEF DESCRIPTION OF THE DRAWINGS

The present invention will be more fully understood and appreciated by reading the following Detailed Description in conjunction with the accompanying drawings, in which.

DETAILED DESCRIPTION OF THE INVENTION

Figure 1:
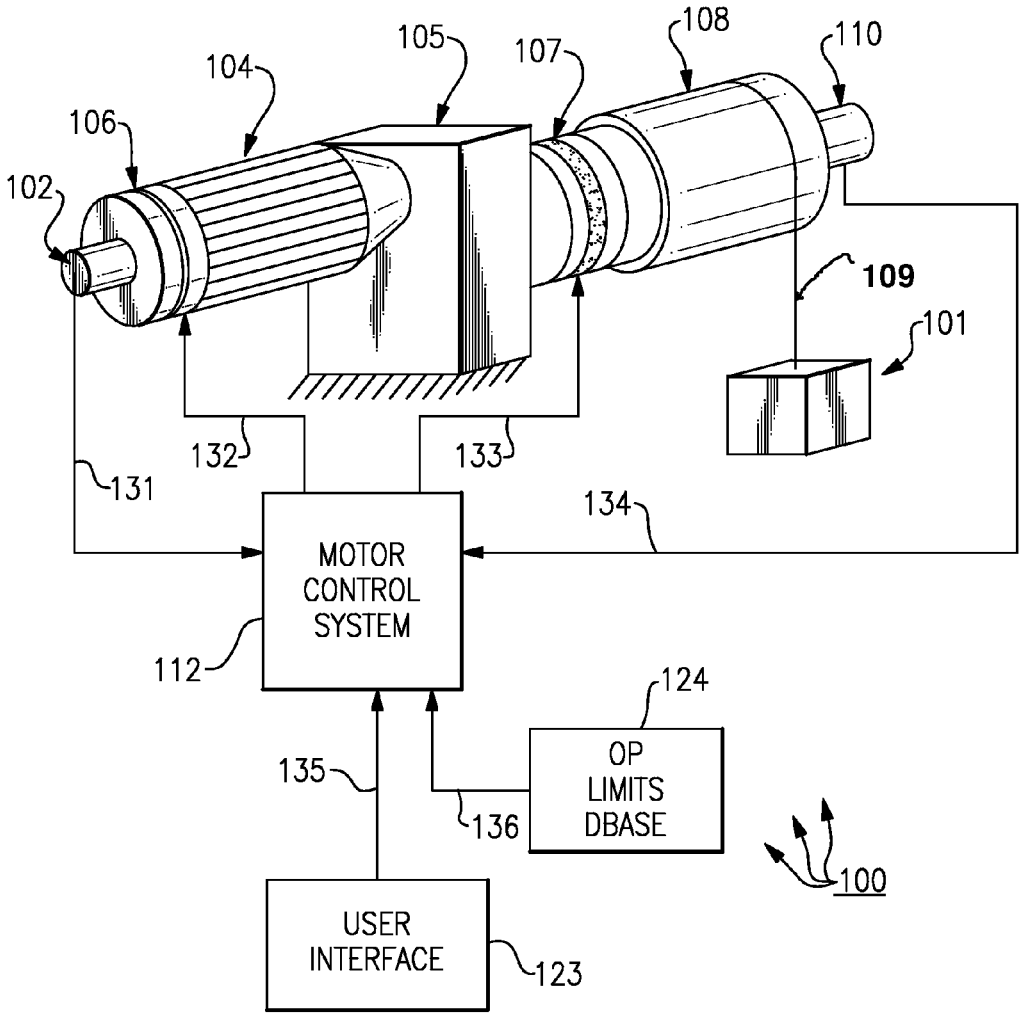
FIG. 1 is a schematic and perspective view of a first embodiment of a hoist system according to the present invention.

FIG. 1 shows hoist system 100 including: load 101; first rotary encoder 102; motor 104; reducer 105; motor brake 106; drum brake 107; drum 108; cable 109; second rotary encoder 110; motor control system 112; user interface 123; and operational limits database 124. In operation, a user interactively uses user interface 123 to direct the motor control system to control the motor to rotationally move the drum. The rotational motion of the drum winds/unwinds a cable to thereby move the load in a desired manner. For example, a speed setpoint command signal 135 may be sent from the user interface to the motor control system to set a speed for turning the motor and thereby turning the drum (through the reducer) to raise or lower the load at a desired speed. Alternatively, desired control of the motor by the motor controller may be partially, or wholly, pre-programmed and/or automatic. In all cases, the motor control system sends appropriate power and/or control signals 132 to the motor to indirectly control the motion of the hoisted load.

The first encoder may be any type of rotary encoder now known or to be developed in the future, and is structured and located to output a signal 131 that corresponds to the rotational motion (for examples, speed, position and/or acceleration) of the motor. The second encoder may be any type of rotary encoder now known or to be developed in the future, and is structured and located to output a signal 134 that corresponds to the rotational motion (for examples, speed, position and/or acceleration) of the drum. The motor control system may take the form of any type of motor controller now known or to be developed in the future, such as motor drive circuitry structured and/or programmed to receive digital control signals and to output an analog power/control signal for controlling and driving an electric motor.

The overspeed protection sub-system of system 100 will now be described. In system 100, the overspeed protection sub-system includes three aspects, or protections, as follows: (i) maximum safe speed aspect; (ii) encoder-encoder comparison aspect; and (iii) encoder-nominal comparison aspect. Preferably all three aspects are present in overspeed protections according to the present invention, but some embodiments of the present invention may not include all three protections.

For purposes of the maximum safe speed aspect of overspeed protection according to the present invention, the maximum safe speed setpoint is stored in operational limits database 124 and sent to the motor control system as max setpoint signal 136. This database may be: (i) included within the hardware of the motor control system; (ii) located outside of the motor control system hardware, but within the hoist assembly; (iii) located at a discrete remote location; or (iv) distributed over multiple locations as a distributed database. There may be more than one maximum safe speed setpoint, such as: (i) separate maximum speed setpoints for up direction and down direction load motion; (ii) separate maximum setpoints depending on the weight of the load; (iii) separate maximum setpoints for motor speed and drum speed; and/or (iv) separate maximum setpoint(s) for nominal rotational speed (that is, the speed that may be requested as a speed setpoint command 135 from user interface 123). In some embodiments, the maximum speed setpoint(s) may be hard-wired into the motor control system, thereby eliminating the need to store this information in any operational limits database. In some embodiments, the maximum speed setpoint(s) may be stored in a relatively permanent fashion, such as a read only memory. In other embodiments, the maximum speed setpoint(s) may be subject to change, such as maximum speed setpoint(s) stored at a remote database under control and supervision of the hoist manufacturer. In addition to, or as an alternative to, maximum safe speed value(s), there may be maximum values for position and/or acceleration. For example, maximum limits on load position as determined by rotary encoder(s) could be used to supplement or even replace conventional position limit switches.

During operation of the hoist the maximum safe speed aspect of overspeed protection operates by having the motor control system: (i) check the rotational speed of the motor, as determined by output data 131 from the first rotary encoder, against any applicable maximum speed setpoint(s) for motor speed; (ii) check the rotational speed of the drum, as determined by output data 134 from the second rotary encoder, against any applicable maximum speed setpoint(s) for drum speed; (iii) checks the speed setpoint command 135, from user interface 123, against any applicable maximum speed setpoints; and (iv) control remedial action(s) to be taken if any maximum setpoint(s) are determined to have been exceeded. The remedial actions may include: (i) activate the motor brake by control signal 132; (ii) activate the drum brake by control signal 133; (iii) stop or slow the motor; (iv) sound an alarm; and/or power down the hoist.

The encoder-encoder comparison aspect of the overspeed protection sub-system of system 100 will now be discussed. In encoder-encoder comparison protection, the output of two different encoders, looking at different locations on the hoist, are compared to each other to detect potential failures or malfunctions. In the exemplary encoder-encoder comparison protection of system 100, the output of the first and second encoders are compared by the motor control system to determine whether there is a difference between motor speed and drum speed large enough to indicate a problem. Of course, because of the gears of the reducer, braking and/or any clutch affects the speeds may not be directly comparable to each other, but the motor control system includes appropriate algorithms, safety factors and/or "fudge" factors for making a meaningful comparison and determining whether the encoder-encoder comparison is indicative of a problem. In the embodiment of system 100, the motor speed is generally greater than the drum speed by a factor equal to the ratio of the speed reducer. Preferably, the first and second encoders are as far apart as possible on opposite ends of the drive train. Preferably, the first and second encoders are on opposite sides of any portion of the drive train that is susceptible to any sort of failure or malfunction. If the comparison of the first and second encoder signals indicates a problem, this usually means that there has been a loss of mechanical rigidity within the drive train, for example, a gear or shaft failure. If the encoder-encoder comparison does indicate a potential problem, then remedial action(s) is/are taken as discussed above in connection with maximum safe speed type protection.

Moving to the encoder-nominal comparison aspect of the overspeed protection sub-system of system 100, if the first and/or second encoders are compared to the nominal speed(s) for the drum and/or motor. In system 100, this nominal speed is generally given by or calculable from the speed setpoint command signal 135. If the motor and/or drum speed(s), a determined from the output signals of the first and/or second encoder(s) respectively, do not match the speed command set point 135, then it is indicative of circumstances such as overload of the hoist, failure of the machinery, or failure of the control system. If the encoder-nominal comparison does indicate a potential problem, then remedial action(s) is/are taken as discussed above in connection with maximum safe speed type protection.

Preferably, system 100 is a high speed hoist. Preferably, system 100 is a variable speed hoist. One preferred feature of system 100 is that the two encoders are at the absolute opposite ends of the rotational drive train 106, 104, 105, 107, 108. This is preferred because a failure in any component will tend to quickly manifest itself as an unexpected difference in the rotational motion respectively detected by the two encoders so that braking will be quickly activated. In this embodiment, encoder output signals 131, 134 and braking control signals 132, 133 are electrical signals. Alternatively, these signals could be any type of data communication (see DEFINITIONS section) signals now known or to be developed in the future.

Hoist system 200 according to the preset invention includes: motor motion detector 202; motor 204; brake 206; drum assembly 208; drum assembly motion detector 210; local controller 212; and remote motor controller 222. The local controller module includes; target motion determination module 214; comparison module 216; local motor control module 218; and actual motion detection module 220. The remote motor controller includes user interface 223. The local controller is located in the hoist assembly in proximity to the hoist hardware. The remote motor controller is located away from the hoist, but is in data communication (see DEFINITIONS section) with the local controller. The remote controller also controls additional hoists (not shown) in the same theater. The remote motor controller exerts its control through digital signals to local controller(s). In embodiment 200, the local controller(s) control the motors and brakes of their respective hoists with analog power/control signals. However, in alternative embodiments, all control may be digital. In still other alternative embodiments, all control may be analog in form. Also, control is not required to be distributed between local and remote controllers. All control could come from a local controller, or all control could come from a remote controller.

Motor motion detector 202 is any type of rotational motion detector now known or to be developed in the future, including, but not necessarily limited to, rotary encoders and/or servo type feedback of a servo-motor. The motor motion detector may detect: (i) position of a rotational component of the motor; (ii) rotational velocity of a rotational component of the motor; (iii) rotational acceleration of a rotational component of the motor; and/or (iv) some combination of these rotational motion characteristics.

Drum assembly 208 may include, for example, a shaft, a sliding drum and a cable. The drum rotates with the rotating shaft, but slides axially back and forth over the rotating shaft in order to maintain a constant fleet angle. Drum assembly motion detector 202 is any type of rotational motion detector now known or to be developed in the future, including, but not necessarily limited to, rotary encoders. The drum assembly motion detector may detect: (i) position of a rotational component of the drum assembly (for example, the shaft); (ii) rotational velocity of a rotational component of the drum assembly; (iii) rotational acceleration of a rotational component of the drum assembly; and/or (iv) some combination of these rotational motion characteristics.

Figure 2:
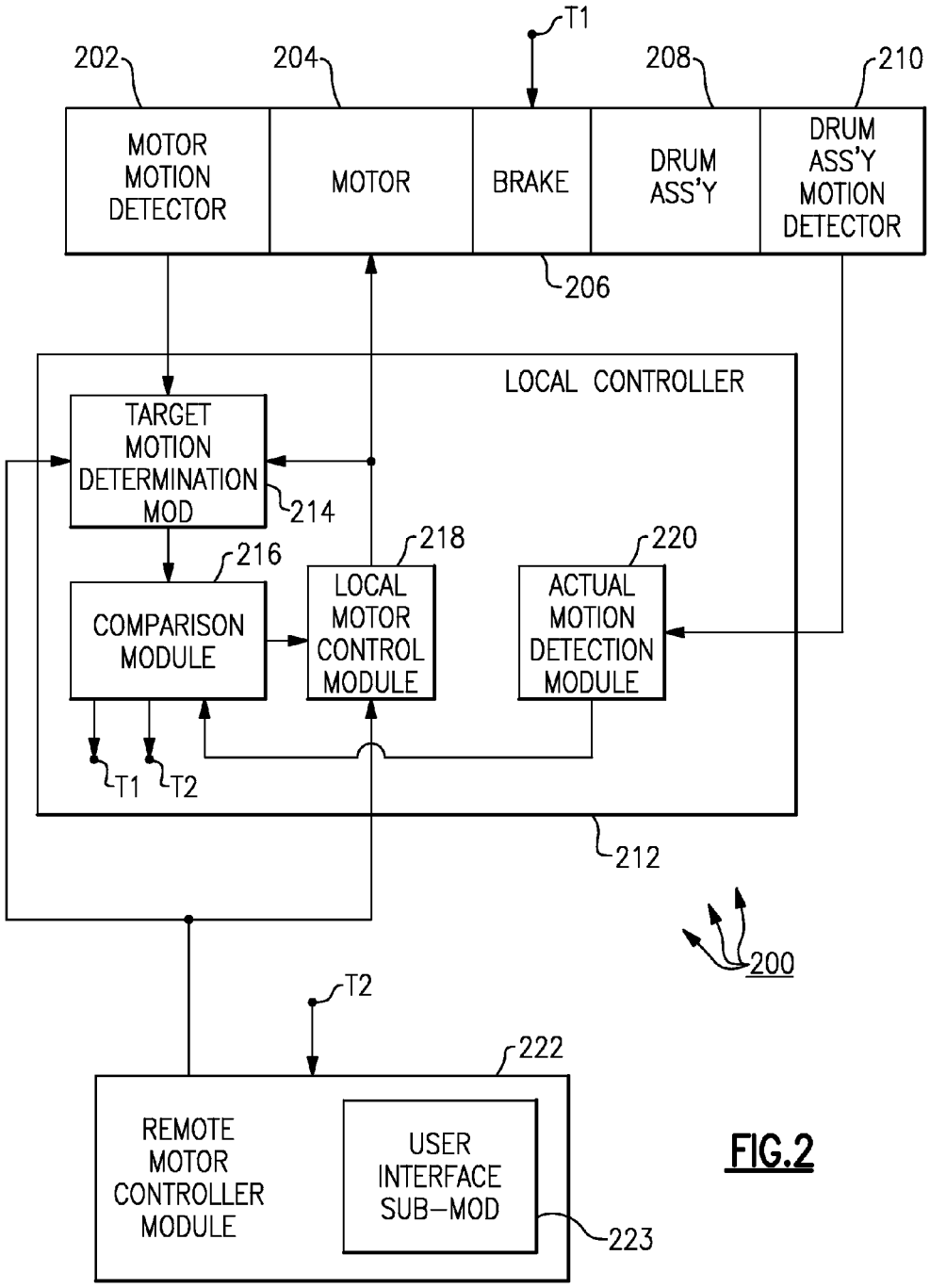
FIG. 2 is a schematic diagram of a second embodiment of a hoist system according to the present invention.

In system 200, the motion (that is, position, velocity and/or acceleration) of direct concern is the rotation of the drum assembly. This motion is determined by actual motion detector module 220 based on the output signal of drum assembly motion detector 210. In this exemplary embodiment, potential problems can be detected on the basis of comparison to three targets: (i) target motion as determined from digital control signals from the remote motor controller; (ii) target motion as determined from analog control signals from the local motor controller; and (iii) target motion as determined from the output signal from the motor motion detector. Various embodiments of the present invention may not do all three comparisons, but they are explained here to help show the full possible scope of the present invention. As shown in FIG. 2, target motion determination module receives: (i) the digital control signals from the remote motor controller; (ii) analog control signals from the local motor control module; and (iii) the output signal from the motor motion detector. All of these various three signals are converted to some kind of a common basis with the basis used for actual drum rotation determined by the actual motion detection module. For example, the basis might be expected acceleration of the drum multiplied by a factor corresponding to the gear ratio between the motor and the drum. As another example, this basis might more simply be the expected rotational velocity of the drum, expressed in encoder marks per second. The identity of the basis does not matter so much as the fact that the basis is a common basis, such that the three target motions can be compared to the actual motion determined by the actual motion detection module.

Comparison module 216 receives: (i) common basis target motion based on the digital control signals from the target motion determination module; (ii) common basis target motion based on the analog control signals from the target motion determination module; (iii) common basis target motion based on the output of the motor motion detector from the target motion determination module; and (iv) common basis actual motion based on the output of the drum assembly motion detector from the actual motion detection module. Each of the common basis target motions (i), (ii) and (iii) are compared to the actual motion (iv). If any of the differences determined by these three comparisons exceeds a predetermined error threshold, then the comparison module commands that remedial action be taken by sending out appropriate control signals to the local motor controller; the remote motor controller and the brake. depending on the type of target motions and actual motions detected and/or calculated, various different kinds of potential problems may be determined by the comparison module including: Possible problems that may be detected by various embodiments of the present invention may include: (i) overspeed; (ii) underspeed; (iii) jerkiness or other sporadic type motion problems; (iv) undertravel; (v) overtravel; (vi) over-acceleration; and (vii) underacceleration.

Figure 3:
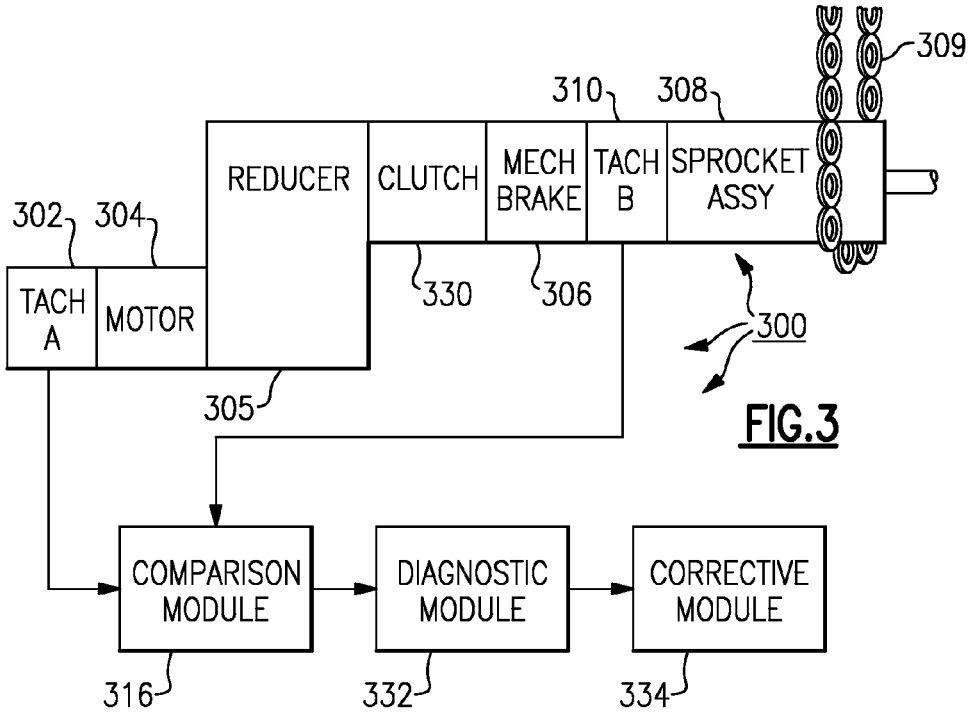
FIG. 3 is a schematic diagram of a third embodiment of a hoist system according to the present invention.
Figure 4:
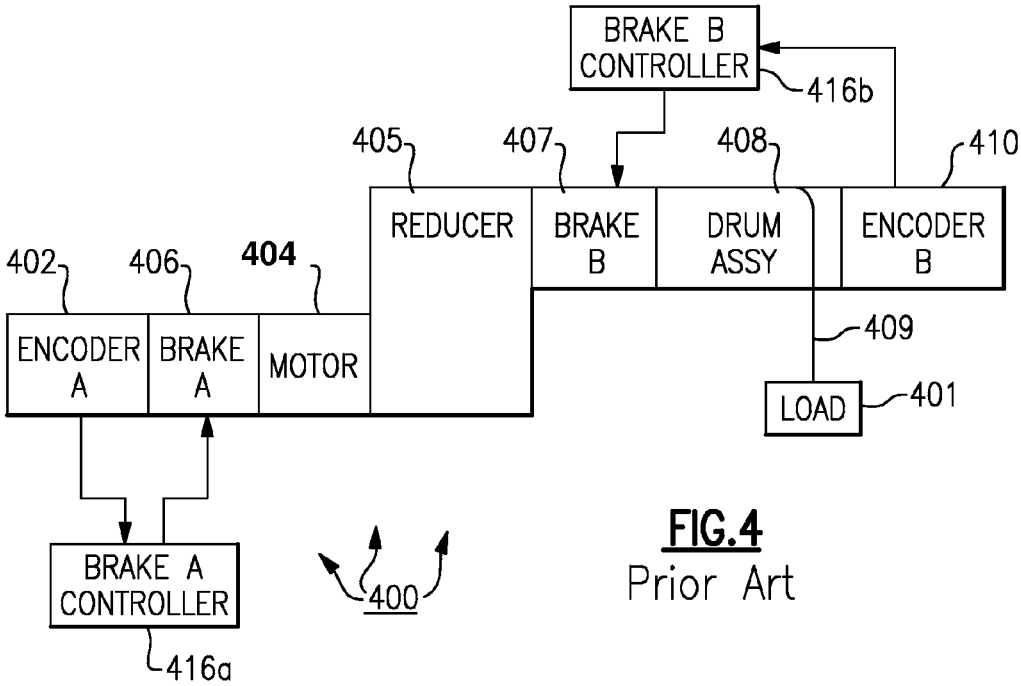
FIG.4 Prior Art
FIG. 4 is a schematic diagram of a conventional hoist system.

FIG. 3 shows sprocket-and-chain hoist system 300 including: first tachometer 302; motor 305; reducer 305; mechanical brake 306; sprocket assembly 308; chain 309; comparison module 316; clutch 330; diagnostic module 332; and corrective module 334. Hoist system 300 is not necessarily a preferred embodiment, but is discussed here to give some idea of the potential scope that the present invention may have. One difference between system 300 and the hoist systems discussed above is that the rotating member of system 300 is a chain-bearing sprocket, rather than a drum wound with a rope. Another difference is that tachometers are used as the rotational detection devices, rather than rotary encoders. Another difference is that the brake is mechanical and does not use or require any sort of control signal.

Perhaps a more fundamental difference between hoist system 300, and the hoist systems previously discussed herein, lies in the use made of the comparison of the respective rotational motions detected respectively by the two rotational motion detectors. Comparison module 316 is programmed to compare the output of the two tachometers to determine an appropriately normalized difference in the rotational motions (that is, velocities, positions and/or accelerations). This data is output to the diagnostic module, which is programmed to analyze the differences either moment-by-moment and/or over a period of time.

Based on this analysis, the diagnostic module determines (or can help determine in co-operation with other diagnostic feedback) whether the hoist is operating normally, or, alternatively, whether any of the following conditions of interest exist: (i) worn clutch; (ii) excessive backlash in gears of the reducer; (iii) chain stretching; or (iv) chain not meshing properly with sprocket. Data corresponding to the results of this analysis is output to the corrective module so the corrective module can control the hoist system to output appropriate indicators to the hoist system operator and/or to take any appropriate automatic correction actions. For example, if the clutch is determined to be worn, the corrective actions are: (i) turn on a worn-clutch indicator light to alert system operator; and (ii) automatically limit operation of the hoist to first gear in order to reduce clutch usage while the clutch is in the worn state. As another example, if the chain is not meshing properly with the sprocket, then the corrective module controls the hoist system to automatically apply lubricant to the sprocket. The foregoing conditions of interest and associated corrective actions are exemplary in nature. The basic idea is that comparison of rotational motions from multiple points on the hoist yields information that may be useful for all kinds of diagnostic and/or corrective purposes.

DEFINITIONS

The following definitions are provided to facilitate claim interpretation:

Present invention: means at least some embodiments of the present invention; references to various feature(s) of the "present invention" throughout this document do not mean that all claimed embodiments or methods include the referenced feature(s).

First, second, third, etc. ("ordinals"): Unless otherwise noted, ordinals only serve to distinguish or identify (e.g., various members of a group); the mere use of ordinals implies neither a consecutive numerical limit nor a serial limitation.

Electrically Connected: means either directly electrically connected, or indirectly electrically connected, such that intervening elements are present; in an indirect electrical connection, the intervening elements may include inductors and/or transformers.

Mechanically connected: Includes both direct mechanical connections, and indirect mechanical connections made through intermediate components; includes rigid mechanical connections as well as mechanical connection that allows for relative motion between the mechanically connected components; includes, but is not limited, to welded connections, solder connections, connections by fasteners (for example, nails, bolts, screws, nuts, hook-and-loop fasteners, knots, rivets, force fit connections, friction fit connections, connections secured by engagement added by gravitational forces, quickrelease connections, pivoting or rotatable connections, slidable mechanical connections, latches and/or magnetic connections).

Data communication: any sort of data communication scheme now known or to be developed in the future, including wireless communication, wired communication and communication routes that have wireless and wired portions; data communication is not necessarily limited to: (i) direct data communication; (ii) indirect data communication; and/or (iii) data communication where the format, packetization status, medium, encryption status and/or protocol remains constant over the entire course of the data communication.

Receive/provide/send/input/output: unless otherwise explicitly specified, these words should not be taken to imply: (i) any particular degree of directness with respect to the relationship between their objects and subjects; and/or (ii) absence of intermediate components, actions and/or things interposed between their objects and subjects.

Cable: include, but is not necessarily limited to metal cables, ropes and/or sprocket driven chains; some cables may stretch or slip with respect to the rotating member that selectively puts them into tension.

Hoist: any device for moving any sort of object (herein called a "load") using a rotating member to selectively apply tension in a cable (see DEFINITIONS section) to which the load is mechanically connected (see DEFINITIONS section); hoists include, but are not necessarily limited to drum hoists with a winding/unwinding cable, sprocket and chain hoists and/or friction drive hoists; preferably, hoists according to the present invention include an electric motor to turn to a rotating drum, and a brake, but this is not necessarily required.

Rotational motion detector: any sort of rotational motion detector for detecting any aspect of rotational motion (for examples, position, velocity or acceleration); rotational motion detectors include, but is not necessarily limited to: absolute rotary encoders; relative rotary encoders; analog encoders; digital encoders; tachometers; fluid couple disc based detectors; and/or resolvers.

Maximum speed set point/maximum operational set point: may be a single constant threshold value, set of discrete threshold values selected according to operating conditions or even a function of algorithm for determining a maximum value depending upon input variables.

Database: may be as simple as a memory and/or storage device that stores a single value.

To compare: to compare directly and/or to compare on any appropriately normalized basis.

Rotational position: may refer to angles and/or negative angles greater than 360 degrees; for example, if a component is turned exactly twice, then its rotational position may be referred to as 720 degrees.

Overspeed: any condition in a hoist system that indicates the need for braking; overspeed conditions include: (i) absolute overspeed where a hoist component is rotating to fast as compared to a maximum speed set point; and (ii) relative overspeed where there is a greater-than-expected mismatch in rotational velocities between two rotating components of a hoist system.

Drum brake: any brake that is at least relatively proximate to a drum assembly without limitation as to the specific type of braking hardware used.

Motor brake: any brake that is at least relatively proximate to a motor, or motor assembly, without limitation as to the specific type of braking hardware used.

control signal/receipt of a control signal/output a control signal: the "control signal" may involve turning an electrical signal off; for example, a "brake off" signal may be constantly applied at a high, or on, state to maintain the brakes in a deactivated state—in this case, the brake control signal would involve switching the "brake off" signal to a low, or off state; control signals are not necessarily limited binary signals or digital signals.

To the extent that the definitions provided above are consistent with ordinary, plain, and accustomed meanings (as generally shown by documents such as dictionaries and/or technical lexicons), the above definitions shall be considered supplemental in nature. To the extent that the definitions provided above are inconsistent with ordinary, plain, and accustomed meanings (as generally shown by documents such as dictionaries and/or technical lexicons), the above definitions shall control. If the definitions provided above are broader than the ordinary, plain, and accustomed meanings in some aspect, then the above definitions shall be considered to broaden the claim accordingly.

To the extent that a patentee may act as its own lexicographer under applicable law, it is hereby further directed that all words appearing in the claims section, except for the above-defined words, shall take on their ordinary, plain, and accustomed meanings (as generally shown by documents such as dictionaries and/or technical lexicons), and shall not be considered to be specially defined in this specification. In the situation where a word or term used in the claims has more than one alternative ordinary, plain and accustomed meaning, the broadest definition that is consistent with technological feasibility and not directly inconsistent with the specification shall control.

Unless otherwise explicitly provided in the claim language, steps in method steps or process claims need only be performed in the same time order as the order the steps are recited in the claim only to the extent that impossibility or extreme feasibility problems dictate that the recited step order (or portion of the recited step order) be used. This broad interpretation with respect to step order is to be used regardless of whether the alternative time ordering(s) of the claimed steps is particularly mentioned or discussed in this document.

What is claimed is:

1. A hoist system comprising a drum assembly, a drum brake, a motor assembly, a motor brake, a first encoder, a second encoder, and a controller module, wherein:

the motor assembly is structured, connected, programmed and/or located to drive the drum assembly to rotate;

the second encoder is connected, structured, connected and/or located to detect rotational velocity of a portion of the drum assembly and to output a second encoder output signal corresponding to the drum assembly rotational velocity;

the first encoder is connected, structured, programmed and/or located to detect rotation of a portion of the motor assembly and to output a first encoder output signal corresponding to the motor assembly rotational velocity;

the controller module is structured, connected and/or programmed to receive the first encoder output signal and the second encoder output signal, to compare the first encoder output signal and the second encoder output signal, to determine whether an overspeed condition exists in the hoist system based on the comparison, and to output a motor brake control signal and a drum brake control signal upon determination of an overspeed condition;

the motor brake is structured, connected, located and/or programmed to receive a motor brake control signal from the controller module and to brake the rotation of the motor upon receipt of the motor brake control signal; and the drum brake is structured, connected, located and/or programmed to receive a drum brake control signal from the controller module and to brake the rotation of the drum assembly upon receipt of the drum brake control signal.

2. The system of claim 1 further comprising a reducer characterized by a gear ratio wherein the controller module is further structured, programmed and/or connected so that the first encoder output signal and the second encoder output signal are compared on a normalized basis that accounts for the gear ratio of the reducer.

3. The system of claim 1 wherein the control module is further structured, programmed and/or connected so that an overspeed condition is only detected when the comparison between the first encoder output signal and the second encoder output signal results in a mismatch that exceeds a predetermined mismatch threshold.

4. The system of claim 1 wherein the drum assembly, drum brake, the motor assembly and the motor brake are all physically located between the first encoder and the second encoder.

5. The system of claim 1 further comprising an operational limits database structured, connected and/or programmed to store and output a motor-related maximum speed set point, wherein the controller module is further structured, connected and/or programmed to receive the motor-related maximum speed set point from the operational limits database, to compare the first encoder output to the motor-related maximum speed set point, to determine whether an overspeed condition exists in the hoist system based on the comparison, and to output the motor brake control signal upon determination of this type of overspeed condition.

6. The system of claim 1 further comprising an operational limits database structured, connected and/or programmed to store and output a drum-related maximum speed set point, wherein the controller module is further structured, connected and/or programmed to receive the drum-related maximum speed set point from the operational limits database, to compare the first encoder output to the drum-related maximum speed set point, to determine whether an overspeed condition exists in the hoist system based on the comparison, and to output the drum brake control signal upon determination of this type of overspeed condition.

7. A hoist system comprising a rotating hoist member assembly, a motor assembly, a first rotational motion detection device, a second rotational motion detection device, a brake and a controller module, wherein:

the motor assembly is structured, connected, programmed and/or located to drive the rotating hoist member assembly to rotate;

the first rotational motion detection device is connected, structured, connected and/or located to detect rotational motion of a first portion of the hoist system and to output a first output signal corresponding to the detected rotational motion;

the second rotational motion detection device is connected, structured, programmed and/or located to detect rotational motion of a second portion of the hoist system (which is different than the first portion) and to output a second output signal corresponding to the detected rotational motion;

the controller module is structured, connected and/or programmed to receive the first output signal and the second output signal, to compare the first output signal and the second output signal, to determine whether a rotational mismatch condition exists in the hoist system based on the comparison, and to output a brake control signal upon determination of an rotational mismatch condition; and the brake is structured, connected, located and/or programmed to receive brake control signals from the controller module and to brake the rotation of the hoist system upon receipt of the brake control signal.

8. The system of claim 7 further comprising a reducer characterized by a gear ratio wherein the controller module is further structured, programmed and/or connected so that the first output signal and the second output signal are compared on a normalized basis that accounts for the gear ratio of the reducer.

9. The system of claim 8 wherein the rotating hoist member assembly, the brake, the motor assembly and the reducer are all physically located between the first rotational motion detection device and the second rotational motion detection device.

10. The system of claim 7 wherein the control module is further structured, programmed and/or connected so that an overspeed condition is only detected when the comparison between the first output signal and the second output signal results in a mismatch that exceeds a predetermined mismatch threshold.

11. The system of claim 7 wherein the first output signal corresponds to rotational position.

12. The system of claim 7 wherein the first output signal corresponds to rotational acceleration.

13. The system of claim 7 wherein the first output signal corresponds to rotational velocity.

14. The system of claim 7 further comprising an operational limits database structured, connected and/or programmed to store and output an operational set point, wherein the controller module is further structured, connected and/or programmed to receive the operational set point from the operational limits database, to compare the first output to the operational set point, to determine whether an incorrect operation condition exists in the hoist system based on the comparison, and to output a brake control signal upon determination of this type of incorrect operation condition.

15. The system of claim 14 wherein:

the operational setpoint corresponds to an overspeed condition; and the first output corresponds to a rotational velocity.

16. The system of claim 14 wherein:

the operational setpoint corresponds to a maximum acceleration; and the first output corresponds to a rotational acceleration.

17. The system of claim 14 wherein:

the operational setpoint corresponds to a positional limit; and the first output corresponds to a rotational position.

18. A hoist system comprising a rotating hoist member assembly, a motor assembly, a first rotational motion detection device, a second rotational motion detection device, and a controller module, wherein:

the motor assembly is structured, connected, programmed and/or located to drive the rotating hoist member assembly to rotate;

the first rotational motion detection device is connected, structured, programmed and/or located to detect rotational motion of a first portion of the hoist system and to output a first output signal corresponding to the detected rotational motion;

the second rotational motion detection device is connected, structured, programmed and/or located to detect rotational motion of a second portion of the hoist system (which is different than the first portion) and to output a second output signal corresponding to the detected rotational motion; and the controller module is structured, connected and/or programmed to receive the first output signal and the second output signal, to compare the first output signal and the second output signal, to determine whether a rotational mismatch condition exists in the hoist system based on the comparison, and to output a control signal upon determination of an rotational mismatch condition.

19. The system of claim 18 wherein the controller module comprises a diagnostic sub-module structured, programmed and/or connected to receive the control signal and to determine, based at least in part on the control signal, whether a condition of interest of a plurality of conditions of interest exists based on the comparison.

20. The system of claim 19 wherein the controller module further comprises a corrective sub-module structured, programmed and/or connected to control the hoist system to make a corrective action based on any condition(s) of interest determined by the diagnostic sub-module.

* * * * *